US005493942A

United States Patent [19]

Wolf

[11] Patent Number: 5,493,942

[45] Date of Patent: Feb. 27, 1996

[54] REMOVABLE DRUMHEAD FOR DRUM BRUSHING

[76] Inventor: Mitchell E. Wolf, 3318 Paula Ann Dr., Taylorsville, Utah 84118

[21] Appl. No.: 181,743

[22] Filed: Jan. 21, 1994

[51] Int. Cl.[6] ..... G10D 13/02

[52] U.S. Cl. ..... 84/411 R

[58] Field of Search ..... 84/411 R, 411 P, 84/414

[56] References Cited

U.S. PATENT DOCUMENTS

| | | | |
|---|---|---|---|
| 2,565,225 | 10/1949 | Gladstone | 84/411 R |
| 3,105,406 | 10/1963 | Ippolito | 84/411 R |
| 3,597,520 | 8/1971 | Andrews | 84/411 R |
| 4,102,235 | 7/1978 | Le Masters | 84/411 R |
| 4,244,266 | 1/1981 | Hardy | 84/411 M |
| 4,254,685 | 3/1981 | Rose | 84/414 |
| 4,308,782 | 1/1982 | Hartry | 84/414 |
| 4,362,081 | 12/1982 | Hartry | 84/414 |
| 4,416,181 | 11/1983 | Hartry et al. | 84/272 |
| 4,567,807 | 2/1986 | Robinson | 84/411 M |
| 4,616,552 | 10/1986 | Jang | 84/414 |
| 4,706,540 | 11/1987 | Donohoe | 84/414 |
| 4,793,121 | 1/1989 | Donohoe | 84/414 |
| 4,809,582 | 3/1989 | Chang | 84/414 |
| 4,899,635 | 2/1990 | Santangelo | 84/411 M |
| 5,091,248 | 2/1992 | Belli | 84/414 X |

OTHER PUBLICATIONS

GE Plastics Publication.

Official Gazette Pub., Oct. 26, 1980, p. 933, 233,604, Manufacture of Celluloid Coated Drumheads.

Official Gazette Pub., May 3, 1960, p. 75, 2,934,989, Drum Head.

Official Gazette Pub., Jun. 2, 1903, 729,936, Drumhead.

Official Gazette Pub., Jul. 13, 1982, 4,338,850, Adjustable Muffler for Percussion Instrument.

Official Gazette Pub., Sep. 27, 1983, p. 1413, 4,406,207, Percussion Practice Pad.

Official Gazette Pub., Apr. 20, 1982, p. 845, 4,325,280, Device for Deadening Drumheads.

Official Gazette Pub., Jul. 16, 1991, p. 1435, 5,031,499, Drum.

Official Gazette Pub., p. 730, 4,671,158, Drum Resonance Eliminator.

Official Gazette Pub., p. 1103, 4,581,973, Pad with Drumhead for Electronic Drum.

Official Gazette Pub., May 24, 1988, p. 1713, 4,745,839, Drum Mute.

Official Gazette Pub., Jun. 4, 1985, 4,520,709, Rimless Drum Structure with Tuning Device.

Official Gazette Pub., p. 446, 3,250,169, Drumhead Construction.

Official Gazette Pub., Jul. 8, 1969, p. 413, 3,453,924, Drum Mute.

*Primary Examiner*—Patrick J. Stanzione

*Attorney, Agent, or Firm*—Trask, Britt & Rossa

[57] ABSTRACT

A removable drumhead for use over atop the existing drumhead of a musical drum is disclosed. The removable drumhead includes a textured playing surface adapted to permit the user to stroke the removable drumhead with a drum brush and obtain a desired musical tone. The removable drumhead is constructed from a thin sheet of supple material such as plastic. The playing surface may be formed to be integral with the body of the sheet of material. The removable drumhead may include a tab-like extension adapted to permit the user to grasp and manipulate the drumhead, e.g. for positioning the removable drumhead atop the existing drumhead or for removing the removable drumhead from the drum.

12 Claims, 3 Drawing Sheets

REMOVABLE DRUMHEAD FOR DRUM BRUSHING

BACKGROUND OF THE INVENTION

1. Field of the Invention

This invention relates to the musical instrument known as a drum. More particularly, the invention is directed to a drumhead which is specifically adapted for practicing the art of drum brushing.

2. State of the Art

Drums have been known and used as musical instruments since the dawn of time. Conventionally, a drum includes a generally cylindrical frame having at least one open end. The end is covered by a rigid or stretched drumhead which produces a tone when caused to vibrate by the application of a force thereto.

In typical practice there exist two principal methods of producing a sound from a drum. In the first method, an elongate stick is used to strike the drumhead. In this method, the surface configuration or texture of the drumhead is of little consequence in determining the type of tone produced by the drumhead. In the second method the user utilizes a brush-like implement which is drawn across the surface of the drumhead to produce a desired tone. In contrast to the first method, the second method is very dependent on the surface texture of the drumhead in that a textured surface is a prerequisite to producing a desirable tone from the drum.

In order to accommodate modern drum players who may frequently alternate during the course of a session between the two methods of drum playing indicated above, present drumheads are textured with a coating to facilitate the use of a drumbrush as well as drumstick. This coating is known in the art as a "Rough-Kote." While this coating has proven effective for moderate periods of use, any sustained striking of such coated drumheads with drumsticks results in the coating becoming detached from the drumhead. Not only does the coating then tend to smear across the face of the drumhead, but furthermore, the coating may actually be transferred to the tip of the drumstick. When the drumstick is subsequently used to strike either another drum or perhaps a cymbal, the coating is oftentimes then transferred to the other drumhead or cymbal. After any prolonged use of such coated drumheads, the associated cymbals begin to appear soiled. Other drumheads, which are not coated, may actually become damaged, due to the transfer of the coating, to the point that they must be replaced.

Recognizing that drumheads are expensive to replace and furthermore recognizing that a significant investment of time is necessary to properly replace and retune a new drumhead, it becomes apparent that there exists a need for a structure which permits the user to obtain the desired tonal qualities produced by drum brushing while avoiding the disadvantages which result from the structures in present use.

SUMMARY OF THE INVENTION

A replaceable and detachable drumhead having a textured surface suitable to produce a desired tone when brushed with a drum brush is disclosed. The drumhead may include a sheet of material which has been fabricated to include a playing surface. The sheet of material is configured as a disk-shaped structure which may conform generally to the configuration of the drumhead of a drum. The sheet is adapted for placement atop a conventional drumhead. The sheet may be used either to alter the tone of the drum or alternatively may be used when it is desired to use a drumbrush. When the user then wants to return to the initial tone of the drum or alternatively use drumsticks on the drumhead, the user merely removes the sheet by grasping the sheet e.g. by use of an extension tab which may be secured to the body of the sheet. The sheet may be retained in position due to its abutment against the upstanding structure of the drum, e.g. the rim, which extends upward about the perimeter of the drumhead or due to the existence of static electricity between the sheet and the drumhead.

DETAILED DESCRIPTION OF THE DRAWINGS

Figure 1:
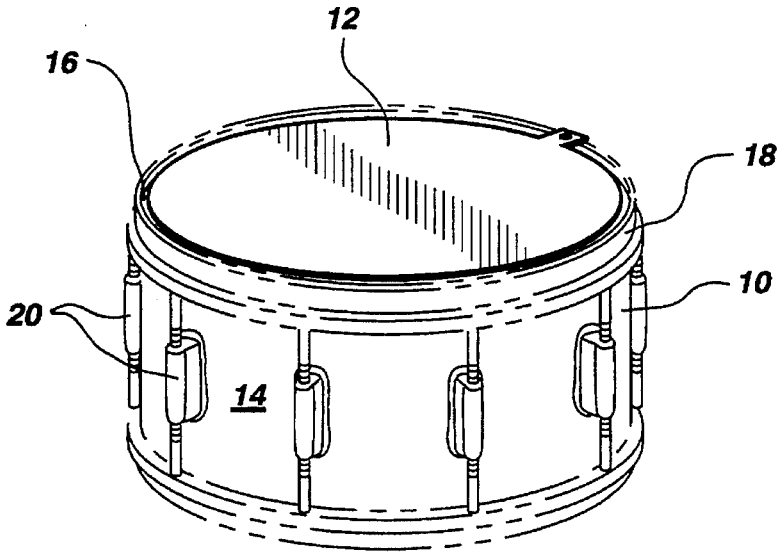
FIG. 1 is a perspective view of a drum having positioned thereon a removable drumhead of the instant invention.
Figure 2:
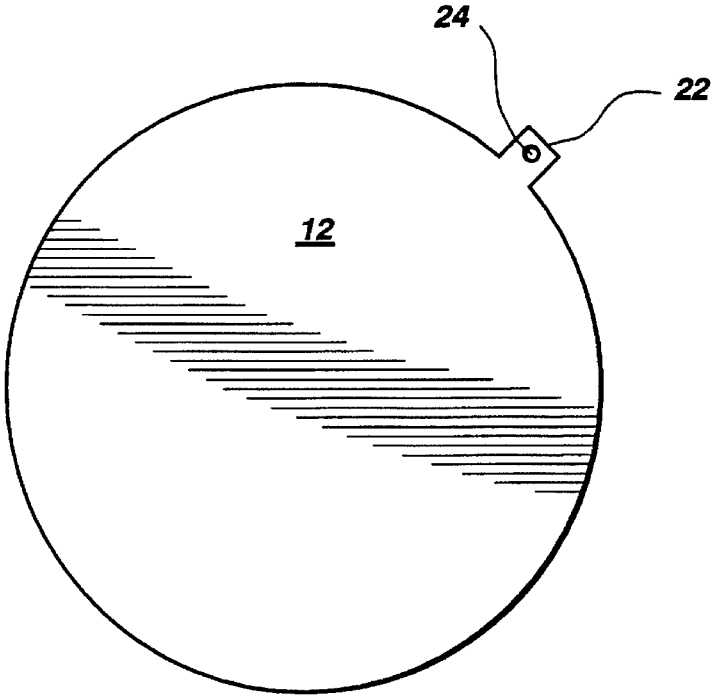
FIG. 2 is a top view of the removable drumhead of the invention.
Figure 3:
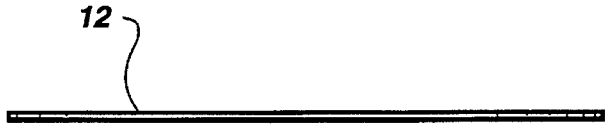
FIG. 3 is a side view of the removable drumhead of FIG. 2.
Figure 4:
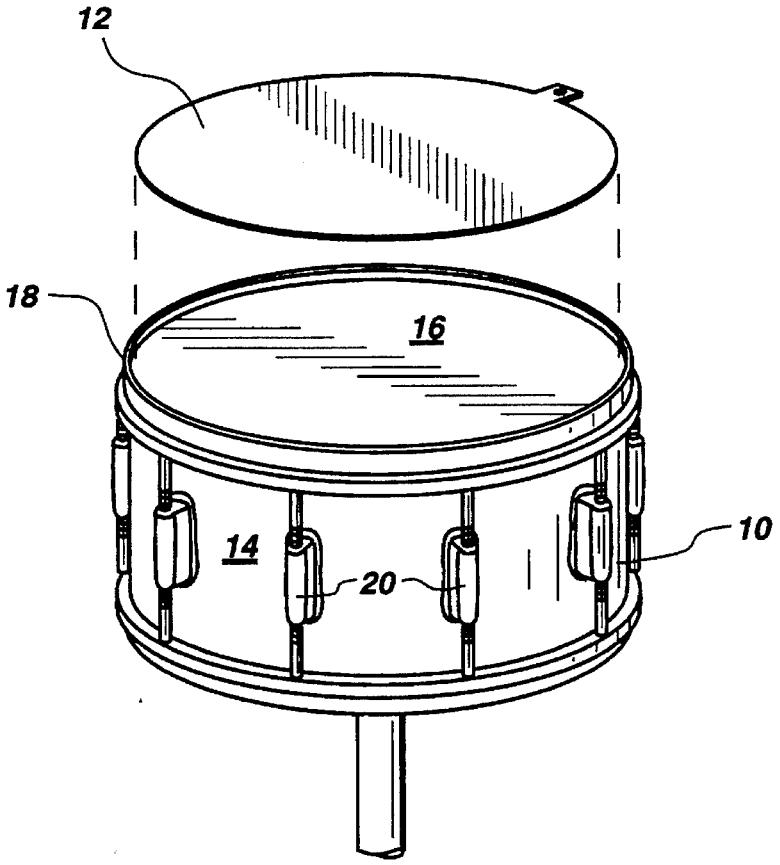
FIG. 4 is an exploded view of a drum in association with a removable drumhead of the invention.
Figure 5:
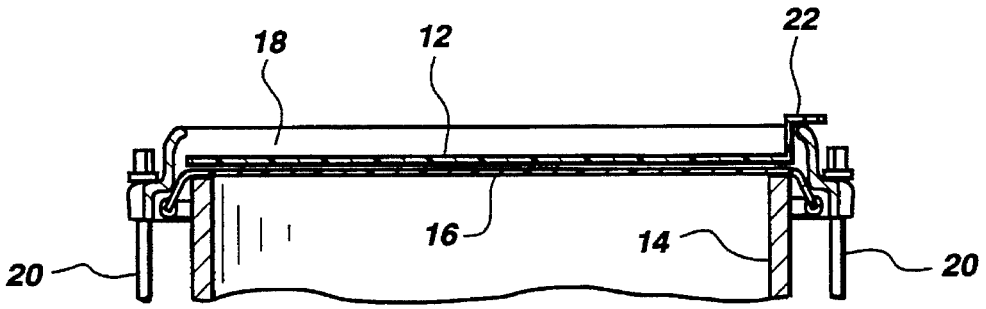
FIG. 5 is a an elevational cross sectional view of a drum with a removable drumhead positioned thereon.

FIG. 1 depicts a drum 10 having positioned atop thereof a removable drumhead 12. As shown, the drum includes a substantially cylindrical frame 14 with a drumhead 16 positioned over an open end of that frame. The drumhead 16 may be of any conventional construction. The frame 14 defines an upstanding rim 18 which extends about the perimeter of the drumhead 16. Rim 18 extends upwardly from the drumhead 16 to define a circular lip about the drumhead 16 which extends upwardly from the horizontal plane defined by the drumhead 16. The drum 10 may include a plurality of tensioning devices 20 which are positioned about the circumference of the exterior surface of the drum frame 14. As shown to advantage in FIGS. 2 and 3, the removable drumhead 12 of the instant invention includes a relatively thin sheet of supple material which has been textured on its upper playing surface. In preferred constructions, the sheet is dimensioned to substantially correspond to the shape of the planar region of the drumhead 16 on which it is placed so that the perimeter of the sheet will contact the rim 18 of the drum. In many embodiments the sheet is configured to be slightly smaller than the drumhead 16.

For those embodiments of the invention which contemplate the use of brushes, the sheet is manufactured from a textured plastic which is made commercially available under the trademark "LEXAN" by the General Electric Company. As shown, the sheet is configured in a generally circular disk shape. The sheet defines two opposing planar surfaces and a circular perimeter or circumference. The preferred thickness of the sheet is 0.010 to 0.040 inches. It has been found that a thickness of 0.020 yields optimal results. It has been found that varying the thickness of the sheet will produce different tones for the drum on which the drumhead is mounted.

In those embodiments wherein the drumhead is specifically adapted for the use of brushes, it has also been discovered that the model of "LEXAN" designated by General Electric as "suede" provides the best sound qualities.

The use of a textured plastic sheet provides several advantages over the conventional coating approach. Since the texture of the drumhead results from actually texturing the body of the drumhead itself, there is no coating which can subsequently be detached from the drumhead. The instant drumhead therefore avoids the marring and smearing which is so common with the coated drumheads. Further, since the marring and smearing of conventional drumheads has been discovered to alter the tonal qualities of the drumhead during use, the instant drumhead provides superior consistency of tonal quality by avoiding such marring and smearing. The instant removable drumhead prolongs the life of associated drumheads and cymbals by removing the possibility of the coating being removed from one drumhead and being deposited on other drumheads and cymbals.

Other types of plastic film may also be utilized to construct the sheet. Polyester, e.g. of the type marketed under the trademark "MYLAR", may be used. Nylon, of the type distributed under the trademark "KEVLAR", may also be used. It has also been found that certain polypropylenes may also be used. Texturing these films by glass peening or sandblasting produces a textured surface which is also usable for the purposes of the instant invention. It has also been found that abrading the playing surface of the drumhead with abrasives, such as sandpaper also produces a textured surface which is functional in the context of the instant invention.

In a further embodiment of the invention which is adapted for altering the tone of the drum instead of providing a surface suitable for brushes, the textured surface is deleted from the sheet from the drumhead 12. It has been found that placing one such removable drumhead atop another removable drumhead alters the tonality of the drum when it is played. The user may therefore construct a series of layers of removable drumheads to obtain a desired tone for the drum. Further, using sheets of varied thickness can also be used to alter the tone of the drum. It should be equally recognized that layers of removable drumheads of varied thicknesses can be used to alter the tonality of the drum.

Figure 6:
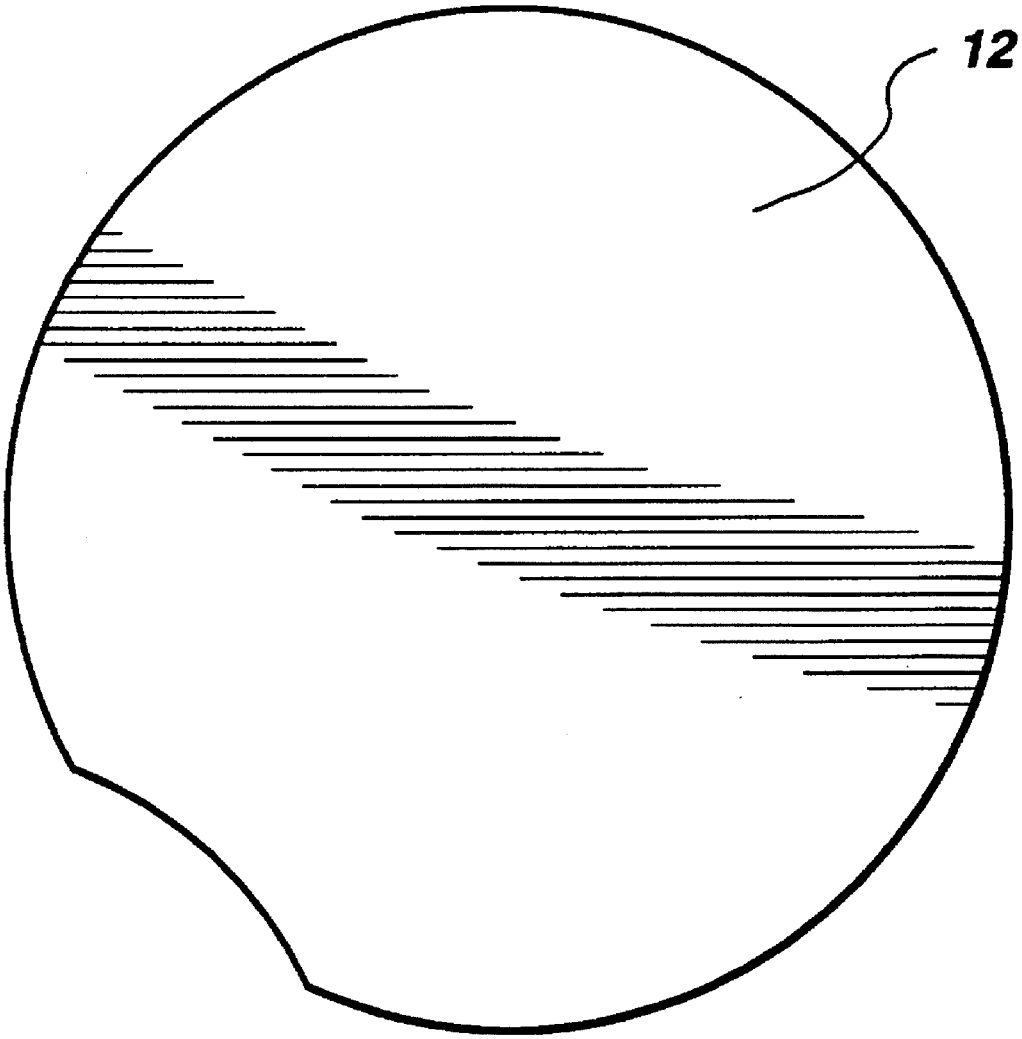
FIG. 6 is a top view of an alternative embodiment of the removable drumhead of the invention.

The drumhead 12 may include a tab-like extension 22 which may be formed integrally with the drumhead itself. As shown, the extension 22 may be generally rectangular in appearance and may have the same thickness as the drumhead itself. The extension may define an aperture 24 (FIG. 2) therein which permits the user to hang the drumhead on any convenient hanger or post. The extension is adapted to facilitate the user placing the drumhead on the existing drumhead of a drum. Equally, the extension 22 permits the user to easily remove the drumhead by simply grasping the extension and pulling the drumhead off of the existing drumhead of the drum. In an alternative embodiment, the tab extension 22 may be deleted and its function replaced by removing an arc-shaped portion from the body of the sheet forming the removable drumhead as shown in FIG. 6.

It is to be understood that the instantly described embodiments are intended solely as a description of preferred embodiments. Those skilled in the art will recognize that the embodiments herein discussed are illustrative of the general principles of the invention. The embodiments herein described are not intended to limit the scope of the claims which themselves recite what applicant regards as his invention.

What is claimed is:

1. A removable drumhead for placement over the exterior playing surface of the drumhead of a drum, said removable drumhead comprising a disk-shaped sheet of material having a thickness of between 0.010 and 0.040 inches, said sheet of material including a playing surface textured for producing a desirable tonal quality when said removable drumhead is stroked with a drum brush, said playing surface being integral with said sheet of material, wherein said sheet of material is dimensioned to abut against the inner diameter of an upstanding rim of a drum on which said removable drumhead is to be placed and about substantially the entire circumference of said inner diameter.

2. The removable drumhead of claim 1 wherein said sheet of material has a thickness of substantially 0.020 inches.

3. The removable drumhead of claim 1 wherein said sheet of material is dimensioned to correspond substantially to the inner diameter of a upstanding rim of a drum on which said removable drumhead is to be placed.

4. A removable drumhead for placement over the exterior playing surface of the drumhead of a drum, said removable drumhead comprising a circular, disk-shaped sheet of plastic material, said sheet of plastic material including a playing surface textured for producing a desirable tonal quality when said removable drumhead is stroked with a drum brush, said playing surface being integral with the body of said sheet of plastic material, said sheet of plastic material being dimensioned to correspond substantially to the circumference of the inner diameter of an upstanding rim of a drum on which said removable drumhead is to be placed wherein said sheet of plastic material abuts against said upstanding rim about substantially the entire circumference of said inner diameter, said sheet of plastic material including a tab-like extension which extends outwardly from said sheet to permit a user to grasp said extension and manipulate said sheet of plastic material.

5. The removable drumhead of claim 4 wherein said sheet of plastic material has a thickness of between 0.010 and 0.040 inches.

6. The removable drumhead of claim 5 wherein said sheet of plastic material has a thickness of approximately 0.020 inches.

7. A removable drumhead for placement over the exterior playing surface of the drumhead of a drum, said removable drumhead comprising a circular, disk-shaped sheet of plastic material, said sheet of plastic material including a playing surface textured for producing a desirable tonal quality when said removable drumhead is stroked with a drum brush, said playing surface including a surface coating which produces a textured, nonuniform surface, said sheet of plastic material being dimensioned to correspond substantially to the circumference of the inner diameter of an upstanding rim of a drum on which said removable drumhead is to be placed wherein said sheet of plastic material abuts against said upstanding rim about substantially the entire circumference of said inner diameter, said sheet of plastic material including a tab-like extension which extends outwardly from said sheet to permit a user to grasp said extension and manipulate said sheet of plastic material.

8. The removable drumhead of claim 7 wherein said sheet of plastic material has a thickness of between 0.010 and 0.040 inches.

9. The removable drumhead of claim 8 wherein said sheet of plastic material has a thickness of approximately 0.020 inches.

10. A removable drumhead for placement over the exterior playing surface of the drumhead of a drum, said removable drumhead comprising a circular, disk-shaped sheet of plastic material, said sheet of plastic material including a playing surface textured for producing a desirable tonal quality when said removable drumhead is stroked with a drum brush, said playing surface having a peened surface which exhibits a textured, nonuniform surface, said sheet of plastic material being dimensioned to correspond substantially to the circumference of the inner diameter of an upstanding rim of a drum on which said removable drumhead is to be placed wherein said sheet of plastic material abuts against said upstanding rim about substantially the entire circumference of said inner diameter, said sheet of plastic material including a tab-like extension which extends outwardly from said sheet to permit a user to grasp said extension and manipulate said sheet of plastic material.

11. The removable drumhead of claim 10 wherein said sheet of plastic material has a thickness of between 0.010 and 0.040 inches.

12. The removable drumhead of claim 11 wherein said sheet of plastic material has a thickness of approximately 0.020 inches.

* * * * *